US010753163B2

(12) United States Patent
Dobkins et al.

(10) Patent No.: US 10,753,163 B2
(45) Date of Patent: Aug. 25, 2020

(54) CONTROLLING A COILED TUBING UNIT AT A WELL SITE

(71) Applicants: Ken P. Dobkins, Conroe, TX (US); William A. Aitken, Calgary (CA); Bo Wu, Spring, TX (US); Jeffrey Martinez, The Woodlands, TX (US); Christopher P. Sartori, The Woodlands, TX (US); Peter Shcheredin, Calgary (CA); Timothy T. Ramsey, Spring, TX (US); Stuart J. Murphy, Spring, TX (US)

(72) Inventors: Ken P. Dobkins, Conroe, TX (US); William A. Aitken, Calgary (CA); Bo Wu, Spring, TX (US); Jeffrey Martinez, The Woodlands, TX (US); Christopher P. Sartori, The Woodlands, TX (US); Peter Shcheredin, Calgary (CA); Timothy T. Ramsey, Spring, TX (US); Stuart J. Murphy, Spring, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 117 days.

(21) Appl. No.: 15/697,919

(22) Filed: Sep. 7, 2017

(65) Prior Publication Data

US 2019/0071941 A1 Mar. 7, 2019

(51) Int. Cl.
*E21B 17/20* (2006.01)
*E21B 19/08* (2006.01)
(Continued)

(52) U.S. Cl.
CPC ..... *E21B 19/22* (2013.01); *E21B 17/20* (2013.01); *E21B 19/08* (2013.01); *E21B 44/02* (2013.01); *B65H 75/425* (2013.01)

(58) Field of Classification Search
CPC ..... E21B 19/22; E21B 44/02; E21B 17/20; E21B 19/08
See application file for complete search history.

(56) References Cited

U.S. PATENT DOCUMENTS 5,447,200 A 9/1995 Dedora et al.
5,850,874 A * 12/1998 Burge ..... B65H 75/22 166/77.3

(Continued)

FOREIGN PATENT DOCUMENTS

| | | | |
|---|---|---|---|
| CA | 2495918 | A1 | 6/2005 |
| CA | 2663989 | A1 | 4/2008 |
| WO | 2016044566 | A1 | 3/2016 |

OTHER PUBLICATIONS

Cenelec, NSAI Standards, I.S. EN 60079-14:2014&AC:2016, "Explosive Atmospheres—Part 14: Electrical Installations design, selection and erection," Feb. 2016, 39 pgs.

*Primary Examiner* — Matthew R Buck
(74) *Attorney, Agent, or Firm* — Cantor Colburn LLP

(57) ABSTRACT

According to one embodiment of the present disclosure, a computer-implemented method for controlling a coiled tubing unit at a well site is provided. The method includes receiving, by a processing device, wellbore data. The method further includes generating, by the processing device, an automated coiled tubing control plan for the coiled tubing unit based at least in part on the wellbore data. The method further includes controlling, by the processing device, the coiled tubing unit using the automated coiled tubing control plan to cause coiled tubing to run into a wellbore at the well site to a target depth, wait a waiting period of time, and cause the coiled tubing to run out of the wellbore.

17 Claims, 4 Drawing Sheets

(51) Int. Cl.

| | |
|---|---|
| ***E21B 19/22*** | (2006.01) |
| ***E21B 44/02*** | (2006.01) |
| *B65H 75/42* | (2006.01) |

(56) References Cited

U.S. PATENT DOCUMENTS

| | | | | |
|---|---|---|---|---|
| 6,116,345 | A * | 9/2000 | Fontana | B65H 75/22 166/343 |
| 6,142,406 | A * | 11/2000 | Newman | B21C 47/18 166/77.2 |
| 6,250,389 | B1 | 6/2001 | Sudol | |
| 7,150,324 | B2 * | 12/2006 | Laursen | E21B 7/128 166/355 |
| 7,284,618 | B2 * | 10/2007 | Geddes | B65H 75/4413 166/384 |
| 8,302,677 | B2 * | 11/2012 | Havinga | E21B 19/22 166/77.1 |
| 8,763,683 | B2 * | 7/2014 | Havinga | E21B 19/22 166/77.1 |
| 9,765,610 | B2 * | 9/2017 | Turner | E21B 17/20 |
| 2008/0217019 | A1 | 9/2008 | Walker et al. | |
| 2011/0144960 | A1 * | 6/2011 | Weng | E21B 44/00 703/2 |
| 2016/0314420 | A1 * | 10/2016 | Livescu | G06Q 10/06313 |
| 2017/0145760 | A1 * | 5/2017 | Poyet | E21B 23/14 |
| 2017/0218733 | A1 * | 8/2017 | Jain | G06F 17/50 |
| 2018/0030792 | A1 * | 2/2018 | Witte | E21B 19/08 |
| 2018/0320461 | A1 * | 11/2018 | Wisinger, Jr. | E21B 44/005 |

* cited by examiner

CONTROLLING A COILED TUBING UNIT AT A WELL SITE

BACKGROUND

Embodiments described herein relate generally to downhole exploration and production efforts and more particularly to techniques for controlling a coiled tubing unit at a well site.

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. Coiled tubing is sometimes used for interventions, completion, and/or production strings to control and/or provide a conduit for fluid flow to and/or from the surface or to provide operations similar to wirelining. Coiled tubing is thus useful in many well operations including circulation, pumping, drilling, logging, perforating, and production. Coiled tubing is transported to a well site on spools or reels. An injector head system provides for the deployment and retrieval of the spooled coiled tubing strings.

SUMMARY

According to one embodiment of the present disclosure, a computer-implemented method for controlling a coiled tubing unit at a well site is provided. The method includes receiving, by a processing device, wellbore data. The method further includes generating, by the processing device, an automated coiled tubing control plan for the coiled tubing unit based at least in part on the wellbore data. The method further includes controlling, by the processing device, the coiled tubing unit using the automated coiled tubing control plan to cause coiled tubing to run into a wellbore at the well site to a target depth, wait a waiting period of time, and cause the coiled tubing to run out of the wellbore.

According to another embodiment of the present disclosure, a system for controlling a coiled tubing unit at a well site is provided. The system includes a memory comprising computer readable instructions, and a processing device for executing the computer readable instructions for performing a method. The method includes receiving, by the processing device, data. The method further includes generating, by the processing device, an automated coiled tubing control plan for the coiled tubing unit based at least in part on the data, wherein the automated coiled tubing control plan comprises a plurality of set points. The method further includes controlling, by the processing device, the coiled tubing unit using the automated coiled tubing control plan by applying the plurality of set points during an operation.

BRIEF DESCRIPTION OF THE DRAWINGS

Referring now to the drawings wherein like elements are numbered alike in the several figures.

DETAILED DESCRIPTION

The present techniques relate to controlling a coiled tubing unit at a well site. Existing coiled tubing units rely on set pressure limits (e.g. a minimum pressure and maximum pressure) to protect coiled tubing. However, existing coiled tubing units are otherwise manual (i.e., performed by an operator), and the limits merely impose limits on the operator's actions. For example, minimum and maximum pressure limits represent pressure limits that can be applied to an injector of the coiled tubing unit and in turn how much weight can be controlled with the coiled tubing. Such limits only restrict an operator's manual inputs to protect the coil tubing from breaking.

The present techniques automate functions of a coiled tubing unit, including pushing the tubing to a target depth at safe speeds (i.e., coil rates) into the well (e.g., run in hole) and pulling the tubing from the well to the surface at safe coil rates (e.g., run out of hole). To do this, the present techniques control an injector head located at the surface. The injector head can be controlled based on a coil rate at which the coiled tubing is being pushed or pulled into or out of the well and/or a pressure applied to the coiled tubing.

Accordingly, the injector head can push the coiled tubing into the well and pull the coiled tubing out of the well automatically. For example, the present techniques push the coiled tubing to a set depth in the well, pick up the coiled tubing, verify the weight and depth of the coiled tubing, and then continue to push the coiled tubing into the well. These functions are controlled automatically based on well site data and equipment data collected by the equipment being used at the well site. This increases efficiency and consistency and provides automation of coiled tubing units at well sites.

Figure 1:
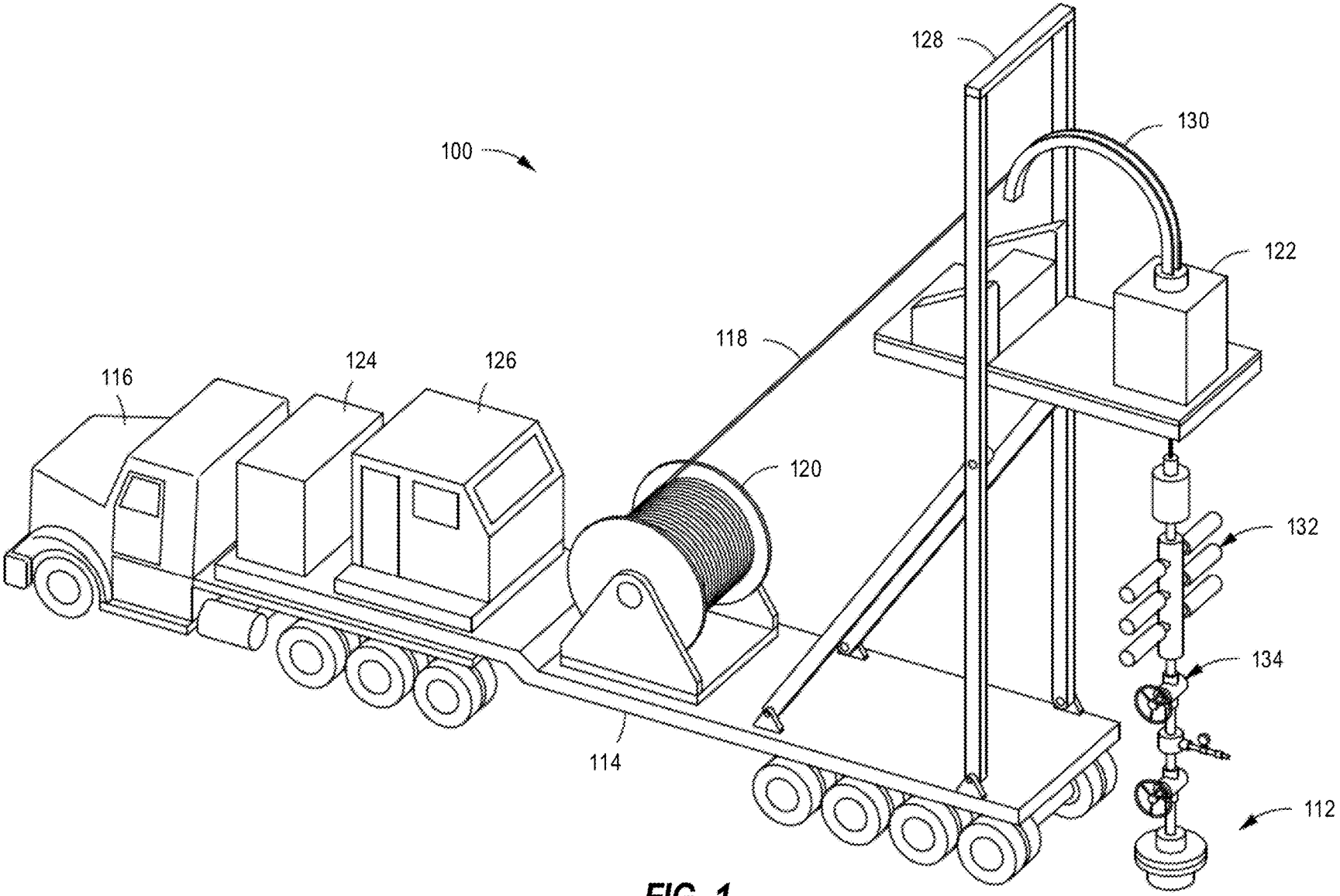
FIG. 1 depicts a side perspective view of a coiled tubing unit in operation at a well site according to aspects of the present disclosure.

FIG. 1 depicts a side perspective view of a coiled tubing unit 100 in operation at a well site 112 according to aspects of the present disclosure. The coiled tubing unit 100 can be trailer mounted upon a trailer bed 114 (or flat car) for transportability, and movable by truck 116, or alternatively by train or another suitable vehicle. In another embodiment, the coiled tubing unit 100 can be provided on an offshore ship or floating rig site, or directly at the surface of the well site 112.

Coiled tubing 118 is spooled on reel 120, disposed on the trailer bed 114, and deliverable to the site 112 by the truck 116. A coiled tubing injector head 122 is arranged to inject the coiled tubing 118 into a borehole that extends downhole from the surface of the well site 112. The injector head 122 is also able to remove the coiled tubing 118 from the borehole.

The coiled tubing unit 100 includes a power pack 124, a control cabin 126, the tubing reel 120, support frame 128 (or crane), gooseneck tubing guide 130, and the injector head 122. The power pack 124 can be a skid that includes the hydraulic pump(s) and return tank(s) (i.e., a hydraulic circuit) for the injector head 122 as well as an injector directional control system. The control cabin 126 includes at least portions of an intelligent injector control system (as will be further described herein), computer, console, seating, monitors, and/or controls.

The support frame 128 supports the injector head 122 at the well site 112, while the gooseneck tubing guide 130 provides the proper radius of curvature and support for the coiled tubing 118 to be spooled off the reel 120 and through the injector head 122. The coiled tubing 118 from the reel 120 is delivered through a blowout preventer stack 132 and wellhead equipment 134 to be pushed into (or pulled out of) the borehole (or casing or other tubular structure within the borehole) by the injector head 122. In some examples, the coiled tubing unit 100 enables the extraction of natural resources.

Figure 2:
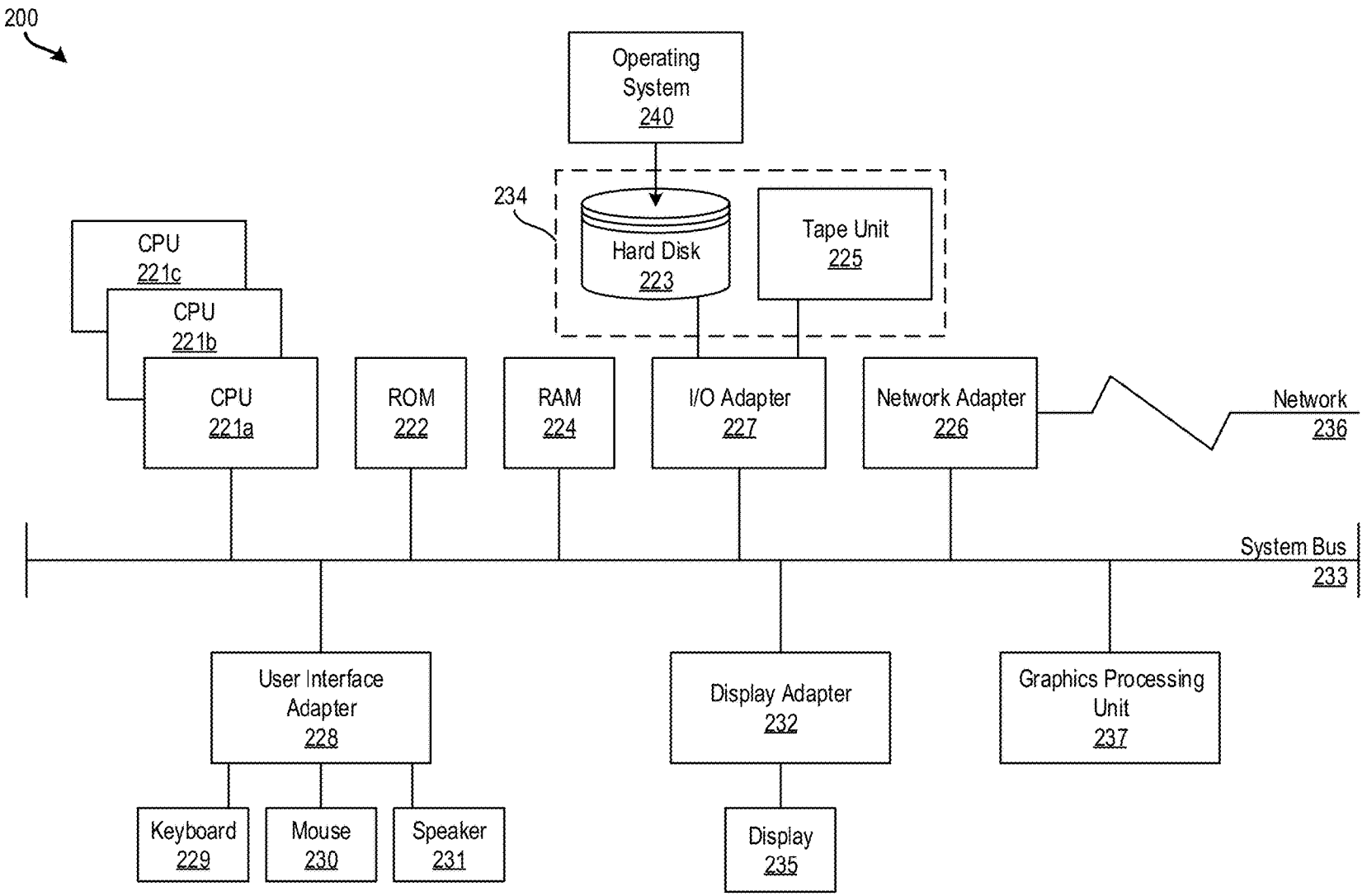
FIG. 2 depicts a block diagram of the processing system, which can be used for implementing the techniques described herein according to aspects of the present disclosure.

It is understood that embodiments of the present disclosure are capable of being implemented in conjunction with any suitable type of computing environment now known or later developed. For example, FIG. 2 depicts a block diagram of a processing system 200, which can be used for implementing the techniques described herein. In examples, processing system 200 has one or more central processing units (processors) 221*a*, 221*b*, 221*c*, etc. (collectively or generically referred to as processor(s) 221 and/or as processing device(s)). In aspects of the present disclosure, each processor 221 can include a reduced instruction set computer (RISC) microprocessor. Processors 221 are coupled to system memory (e.g., random access memory (RAM) 224) and various other components via a system bus 33. Read only memory (ROM) 222 is coupled to system bus 233 and can include a basic input/output system (BIOS), which controls certain basic functions of processing system 200.

Further illustrated are an input/output (I/O) adapter 227 and a communications adapter 226 coupled to system bus 233. I/O adapter 227 can be a small computer system interface (SCSI) adapter that communicates with a hard disk 223 and/or a tape storage drive 225 or any other similar component. I/O adapter 227, hard disk 223, and tape storage device 225 are collectively referred to herein as mass storage 234. Operating system 240 for execution on processing system 200 can be stored in mass storage 234. A network adapter 226 interconnects system bus 233 with an outside network 236 enabling processing system 200 to communicate with other such systems.

A display (e.g., a display monitor) 235 is connected to system bus 233 by display adaptor 232, which can include a graphics adapter to improve the performance of graphics intensive applications and a video controller. In one aspect of the present disclosure, adapters 226, 227, and/or 232 can be connected to one or more I/O busses that are connected to system bus 233 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 233 via user interface adapter 228 and display adapter 232. A keyboard 229, mouse 230, and speaker 231 can be interconnected to system bus 233 via user interface adapter 228, which can include, for example, a Super I/O chip integrating multiple device adapters into a single integrated circuit.

In some aspects of the present disclosure, processing system 200 includes a graphics processing unit 237. Graphics processing unit 237 is a specialized electronic circuit designed to manipulate and alter memory to accelerate the creation of images in a frame buffer intended for output to a display. In general, graphics processing unit 237 is very efficient at manipulating computer graphics and image processing and has a highly parallel structure that makes it more effective than general-purpose CPUs for algorithms where processing of large blocks of data is done in parallel.

Thus, as configured herein, processing system 200 includes processing capability in the form of processors 221, storage capability including system memory (e.g., RAM 224), and mass storage 234, input means such as keyboard 229 and mouse 230, and output capability including speaker 231 and display 235. In some aspects of the present disclosure, a portion of system memory (e.g., RAM 224) and mass storage 234 collectively store an operating system 240 to coordinate the functions of the various components shown in processing system 200.

Figure 3:
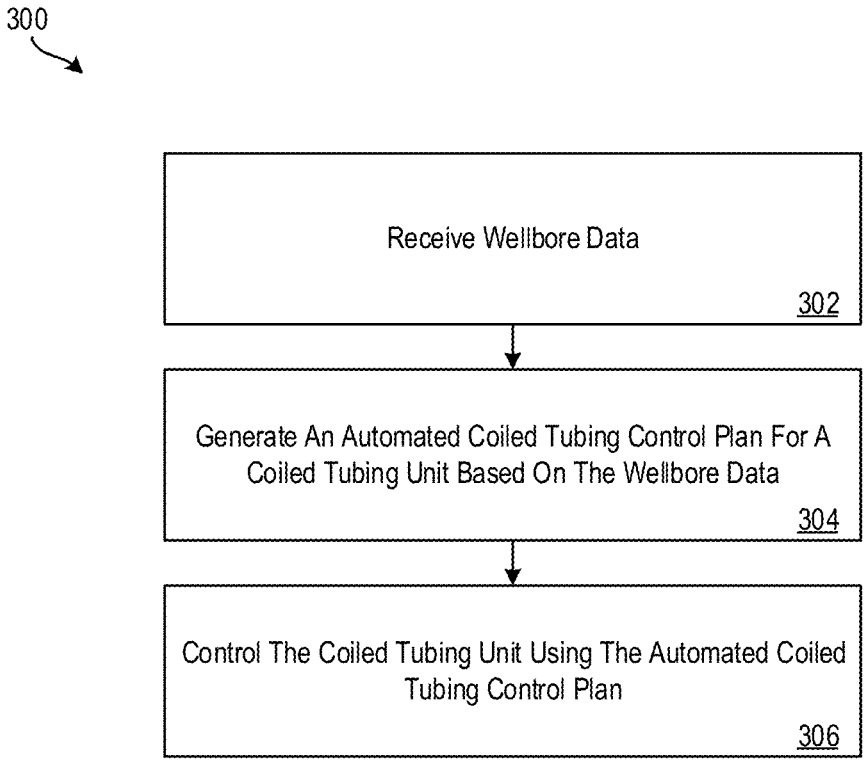
FIG. 3 depicts a flow diagram of a method for controlling a coiled tubing unit at a well site according to aspects of the present disclosure.

FIG. 3 depicts a flow diagram of a method 300 for controlling the coiled tubing unit 100 at a well site according to aspects of the present disclosure. The method 300 can be implemented by any suitable processing systems, such as the processing system 200 of FIG. 2 or the system 400 of FIG. 4 (described below). Although the coiled tubing unit can be the coiled tubing unit 100 of FIG. 1, the coiled tubing unit can also be another suitable coiled tubing unit.

At block 302, a processing system (e.g., the processing system 200) receives wellbore data. The wellbore data can be collected using sensors in the wellbore or at the well site, and/or the wellbore data can be received from a third-party vendor, customer, or other similar entity.

At block 304, the processing system generates an automated coiled tubing control plan for the coiled tubing unit 100 based at least in part on the wellbore data. According to aspects of the present disclosure, the automated coiled tubing control plan defines a coil rate, a direction, and/or a force for controlling the coiled tubing unit 100. In some examples, the coil rate, the direction, and/or the force are set differently for different depths such that the coil rate, direction, and/or force can change as the depth changes. This enables the coiled tubing unit 100 to operate in formations with different characteristics, for example, and to account for changes in depth and pressure. The automated coiled tubing control plan is discussed further herein.

At block 306, the processing system controls the coiled tubing unit 100 using the automated coiled tubing control plan. For example, controlling the coiled tubing unit 100 can include causing the coiled tubing to run into the wellbore to a target depth (run-in-hole), waiting a waiting period of time (e.g., during which a new target depth is entered that can be above the current depth or below the current depth), and causing the coiled tubing to run out of the wellbore (run-out-of-hole). Controlling the coiled tubing unit 100 can include controlling a hydraulic system (e.g., an electric over hydraulic system) that controls the injector head 122 and/or other components of the coiled tubing unit, such as valves, pumps, etc. Controlling the hydraulic system can utilize a programmable logic controller to send commands to cause actuators in the hydraulic system to manipulate components (e.g., valves, pumps, etc.) based on the commands. According to aspects of the present disclosure, during the waiting period, the coiled tubing unit 100 can switch from an automated mode to a manual mode to enable an operator to manually control the coiled tubing unit 100.

According to aspects of the present disclosure, causing the coiled tubing to run-out-of-hole can include causing the coiled tubing to run fully out of the wellbore or causing the coiled tubing to run partially out of the wellbore. For example, causing the coiled tubing to run partially out of the wellbore can be used to perform a verification procedure while running the coiled tubing into the well bore. The verification procedure can include stopping the run-in-hole, picking up (i.e., reversing) the coiled tubing (e.g., 10 feet, 50 feet, 70 feet, 100 feet, 175 feet etc.), testing weight on the coiled tubing, and then, if verified (e.g., if the weight on the coiled tubing is approximately equal to an expected weight on the coiled tubing), continuing to run-in-hole. If the verification procedure fails, the run-in-hole may be aborted, an operator may take a corrective action, a corrective action may be automatically implemented, etc.

Additional processes also can be included. For example, the automated coiled tubing control plan can be updated based on sensor data received from a sensor (e.g., a pressure sensor, a temperature sensor, a force sensor, etc.) and/or a sensor array positioned at an end of the coiled tubing that is in the wellbore. This enables real-time adjustment of the coiled tubing unit based on sensed conditions in the wellbore. It should be understood that the processes depicted in FIG. 4 represent illustrations and that other processes can be added or existing processes can be removed, modified, or rearranged without departing from the scope and spirit of the present disclosure.

Figure 4:
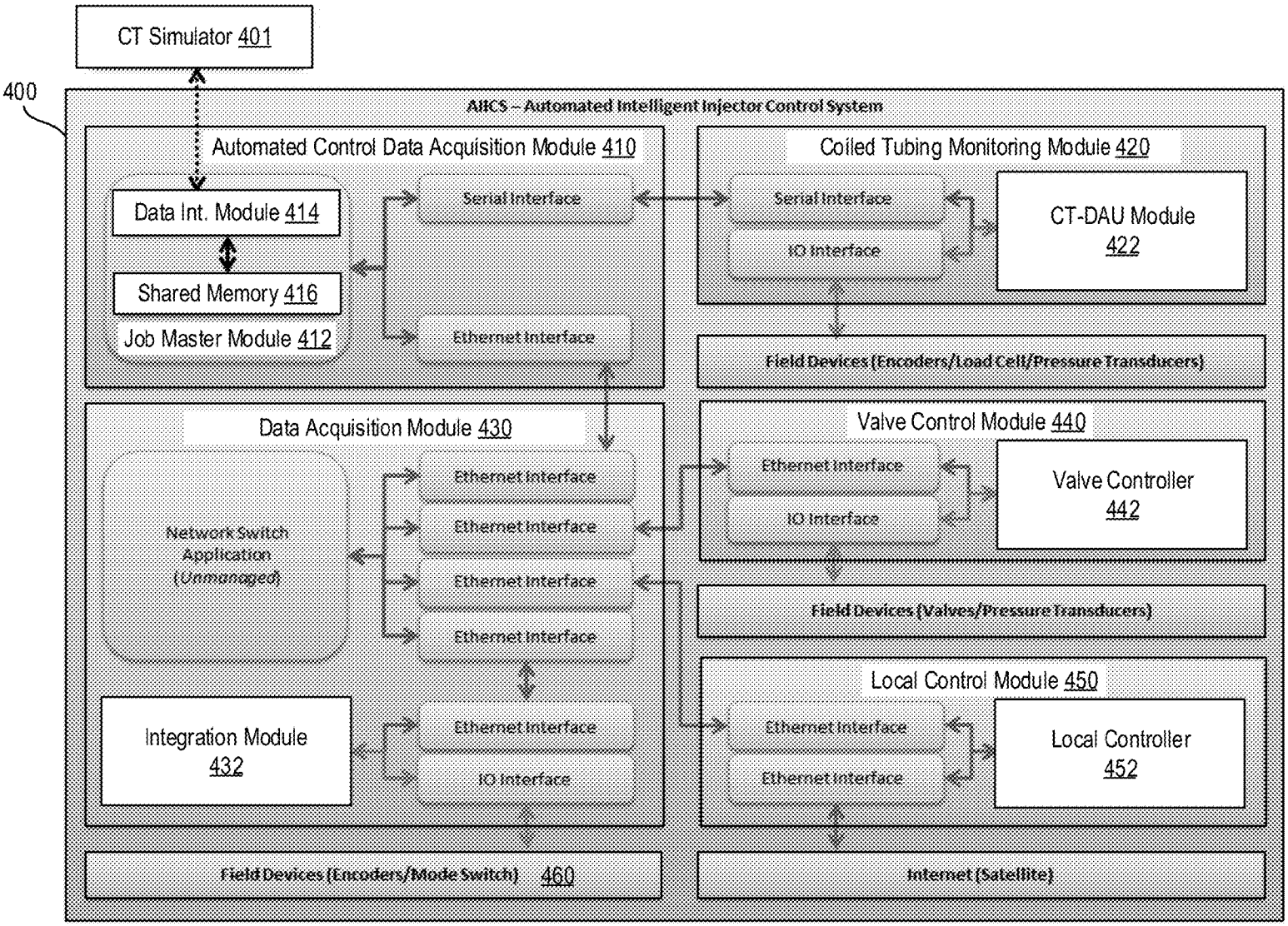
FIG. 4 depicts a block diagram of a system for controlling a coiled tubing unit at a well site according to aspects of the present disclosure.

FIG. 4 depicts a block diagram of a system 400 for controlling a coiled tubing unit at a well site according to aspects of the present disclosure. The system 400, which may be referred to as an automated intelligent injector control system (AIICS), includes different modules responsible for control and data acquisition, and the modules are communicatively connected to one another as shown, for example. The coiled tubing unit can be the coiled tubing unit 100 of FIG. 1 or another suitable coiled tubing unit.

Generally, intelligent injector control systems (IICS) perform low-level control of hydraulic circuits used in well site operations. For example, hydraulic circuits can be used to vary pump pressures and valve positions to regulate the flow of hydraulic fluid to operate equipment within the well site operation. AIICS (e.g., the system 400) can expand upon IICS features by adding automated coil rate and directional control capabilities of coiled tubing units. Control set points can be defined and converted to electrical signals that the hydraulic circuits can use to vary pump pressures and valve positions to control the coiled tubing unit.

In the example of FIG. 4, the system 400 includes an automated control data acquisition module 410, a coiled tubing monitoring module 420, a valve control enclosure 440, a data acquisition module 430, and a local control module 450. It should be appreciated that other modules/components can also be included.

The automated control data acquisition module 410 performs real-time updates of coiled tubing simulation data, which is compiled from well site information. The well site information can be provided, for example, by a third-party and can specify the equipment being used at the well site.

The automated control data acquisition module 410 includes a job master module 412 having a shared memory and a data integration module 414. The data integration module 414 receives the coiled tubing simulation data from a coiled tubing (CT) simulator 401. Based on the CT data, as well as data received from the coiled tubing monitoring module 420 and the data acquisition module 440 (each described herein), the data integration module 414 defines safety/operational set points (e.g., coil rates, target depths, etc.) and provides warnings and alerts to well site operators/technicians during coiled tubing units.

For example, the data integration module 414 receives a "target depth" from an operator. The target depth corresponds to a desired "treatment depth." The data integration module 414 then trips (i.e., runs in hole) with weight tests, obstacle avoidance, etc., to that target depth (e.g. 10,000 ft). Once the coil reaches the target depth, the data integration module 414 automatically goes enters a "pause" mode and waits a waiting period of time so that a treatment can occur. When the treatment is over, the operator then re-enters the "active" mode and inputs another target depth (e.g., 0.0 ft). The data integration module 414 then trips out (i.e., runs out of hole) avoiding obstacles, etc.

The job master module 412 functions as a communication controller (e.g., a Modbus TCP/IP master) and performs real-time data acquisition functions to collect job data from the various modules within the system 400. The job master module 412 can utilize Ethernet sub-systems, for example, and can also form a communicative interface to connect to the coiled tubing monitoring module 420 via serial interfaces within each module. The job master module 412 uses a shared memory interface for communication with the data integration module 414. This interface enables the data integration module to access the various data/parameters that the job master module 412 records.

The automated control data acquisition module 410 can also include an interface(s) (e.g., a serial interface, an Ethernet interface, an I/O interface, etc.) to communicatively connect the automated control data acquisition module 410 to other modules, such as the coiled tubing monitoring module 420 and/or the data acquisition module 440, among others.

The coiled tubing monitoring module 420 monitors the coiled tubing unit (e.g., the coiled tubing unit 100) and collects data relating thereto in real time. The coiled tubing monitoring module 420 includes a coiled tubing data acquisition unit (CT-DAU) module 422 and can also include an interface(s) (e.g., a serial interface, an Ethernet interface, an I/O interface etc.) to communicatively connect the coiled tubing monitoring module 420 to other modules, such as the automated control data acquisition module 410 and/or field devices (e.g., encoders, load cells, pressure transducers, etc.), among others. The field devices are devices associated with the coiled tubing unit (e.g., the coiled tubing unit) and provide data to the coiled tubing monitoring module 420 via the I/O interface, for example.

The CT-DAU module 422 performs real-time updates for field device measurements including measures from a dual encoder (used to calculate a depth that the coiled tubing has traveled down the well) and a load cell (used to calculate a weight applied to the coiled tubing). Feedback requirements for the CT-DAU module 422 can vary based on the coiled tubing job design and could utilize more feedback for data recording and analysis purposes.

The data acquisition module 430 includes an integration module 432 and can also include an interface(s) (e.g., a serial interface, an Ethernet interface, an I/O interface etc.) to communicatively connect the data acquisition module 430 to other modules, such as the automated control data acquisition module 410, the valve control module 440, the local control module 450, etc. The data acquisition module 430 can also include a network switch application to manage data transfers via the interfaces. The integration module 432 performs real-time updates for field device measurements, such as redundant calculation of depth from a dual encoder measurement, and functions as a communication controller (e.g., a Modbus TCP/IP master) to manage the flow of control commands.

The valve control module 440 performs low-level control of injector and traction pressures to maintain equipment weight limitations provided by the data integration module 414. The present techniques enable speed, direction, and tension control for the coiled tubing unit 100. The depth and coil rate set points provided by the data integration module 414, the equipment specification, and the hydraulic circuit design are used to develop the functionality used for the low-level control. The valve control module 440 includes a valve controller 442 and can also include an interface(s) (e.g., a serial interface, an Ethernet interface, an I/O interface etc.) to communicatively connect the valve control module 440 to other modules, such as the data acquisition module 430 and/or field devices (e.g., encoders, load cells, pressure transducers, etc.), among others.

The local control module 450 includes a local controller 452 that functions as a communication controller (e.g., a Modbus TCP/IP master) and is used to enter calibration parameters for field devices, view diagnostic information, and perform control functions to test the coiled tubing unit 100 prior to enabling automated control. The local control module 440 also can include an interface(s) (e.g., a serial interface, an Ethernet interface, an I/O interface etc.) to communicatively connect the local control module 450 to other modules, such as the data acquisition module 430 and/or a network connection (e.g., the Internet, a satellite communication connection, a broadband communication connection, etc.).

The system 400 can be configured to generate an automated coiled tubing control plan and to control the coiled tubing unit 100 using the automated coiled tubing control plan, as described with respect to FIG. 3. According to aspects of the present disclosure, different automated coiled tubing control plans (i.e., integrated control procedures) are possible. For example, automated coiled tubing control plans can define various ready procedures, automated control mode procedures, and local control mode procedures. These procedures are described below, although it should be appreciated that the procedures are merely examples and that other procedures, modifications thereto, and/or combinations thereof are also possible.

Examples of ready procedures can include an automated control mode ready procedure, a local control mode ready procedure, a manual control mode with IICS active ready procedure, and a manual control mode ready procedure. The integration module 432 reads inputs from a mode switch of field devices 460 and determines which of an automated or local (i.e., manual) control mode to make ready. Automated and local control modes use an extra signal to begin the operation of the coiled tubing unit 100 and described below. Manual control modes may or may not use a starting procedure The automated control mode ready procedure is implemented when the mode switch is in the automated control mode position. The integration module 432 reads the automated control mode input from the mode switch and sends an automated control mode alarm to the job master module 412. The data integration module 414 reads the alarm from the job master module 412 and configures itself for automated control mode. The integration module 432 checks that there are no field device measurements or controls in an unsafe state for the transfer to automated control. If it is determined that a field device measurement or control is in an unsafe state, the integration module 432 sends a low-level common fault alert. However, if it is safe to proceed, the integration module 432 sends a ready signal to the job master module 412. The data integration module 414 reads the ready signal from the job master module 412. The automated control mode ready procedure can also run as a background task during which the valve controller 442 maintains a safe pressure reference for the hydraulic system (s) in the coiled tubing unit 100 using real-time updates from field device measurements and data provided by the job master module 412. The data integration module 414 performs real-time updates of data (e.g., field device measurements, automated controls and feedback, etc.) using updated samples from the shared memory 416 of the job master module 412. The job master module 412 performs real-time updates to the communication controller aspects of the job master module 412 and the other interfaces (e.g., a serial interface, an Ethernet interface, etc.) of the automated control data acquisition module 410. The coiled tubing data acquisition module 422 performs real-time updates of field device measurements and output registers.

The local control mode ready procedure is implemented when the mode switch is in the local (i.e., manual) control mode position. The integration module 432 reads the local control mode input from the mode switch of the field devices 460 and sends a local control mode alarm to the job master module 412. The data integration module 414 reads the alarm from the job master module 412 and configures itself for local control mode. The integration module 432 checks that there are no field device measurements or controls in an unsafe state for the transfer to local control. If it is determined that a field device measurement or control is in an unsafe state, the integration module 432 sends a low-level common fault alert. However, if it is safe to proceed, the integration module 432 sends a ready signal to the local controller 452. The local controller 452 reads the ready signal from the integration module 432. The local control mode ready procedure can also run as a background task during which the valve controller 442 maintains a safe pressure reference for the hydraulic system(s) in the coiled tubing unit 100 using real-time updates from field device measurements and data provided by the job master module 412. The data integration module 414 performs real-time updates of data (e.g., field device measurements, automated controls and feedback, etc.) using updated samples from the shared memory 416 of the job master module 412. The job master module 412 performs real-time updates to the communication controller aspects of the job master module 412 and the other interfaces (e.g., a serial interface, an Ethernet interface, etc.) of the automated control data acquisition module 410. The coiled tubing data acquisition module 422 performs real-time updates of field device measurements and output registers.

The local control mode with IICS active ready procedure is implemented when the mode switch is in the manual control with IICS active mode position. The integration module 432 reads the manual control with IICS active mode input from the mode switch of the field devices 460 and sends a manual control with IICS active mode alarm to the job master module 412. The data integration module 414 reads the alarm from the job master module 412 and configures itself for manual control with IICS active mode. The integration module 432 checks that there are no field device measurements or controls in an unsafe state for the transfer to local control. If it is determined that a field device measurement or control is in an unsafe state, the integration module 432 sends a low-level common fault alert. However, if it is safe to proceed, the integration module 432 transfers control of the pressure reference for the injector head, traction, and tension pressure to an operator for example. The manual control mode with IICS active ready procedure can also be run as a background task during which the valve controller 442 maintains a safe pressure reference for the hydraulic system(s) in the coiled tubing unit 100 using real-time updates from field device measurements and data provided by the job master module 412. The data integration module 414 performs real-time updates of data (e.g., field device measurements, automated controls and feedback, etc.) using updated samples from the shared memory 416 of the job master module 412. The job master module 412 performs real-time updates to the communication controller aspects of the job master module 412 and the other interfaces (e.g., a serial interface, an Ethernet interface, etc.) of the automated control data acquisition module 410. The coiled tubing data acquisition module 422 performs real-time updates of field device measurements and output registers.

The local control mode ready procedure is implemented when the mode switch is in the manual control mode position. The integration module 432 reads the manual control mode input from the mode switch of the field devices 460 and sends a manual control mode alarm to the job master module 412. The data integration module 414 reads the alarm from the job master module 412 and configures itself for manual control mode. The integration module 432 checks that there are no field device measurements or controls in an unsafe state for the transfer to local control. If it is determined that a field device measurement or control is in an unsafe state, the integration module 432 sends a low-level common fault alert. However, an override can be implemented by the local control module 450 to override the fault and continue to manual mode. If it is safe to proceed, the integration module 432 transfers control of the pressure reference for the injector head, traction, and tension pressure to an operator for example. The manual control mode ready procedure can also be run as a background task during which the integration module 432 performs real-time updates of field device measurements and monitors the current mode of operation. The data integration module 414 performs real-time updates of data (e.g., field device measurements, automated controls and feedback, etc.) using updated samples from the shared memory 416 of the job master module 412. The job master module 412 performs real-time updates to the communication controller aspects of the job master module 412 and the other interfaces (e.g., a serial interface, an Ethernet interface, etc.) of the automated control data acquisition module 410. The coiled tubing data acquisition module 422 performs real-time updates of field device measurements and output registers.

Examples of automated control mode procedures can include an activating procedure, a pausing procedure, a fault procedure, a weight test control procedure, and an obstacle navigation control procedure.

The activating procedure occurs when an operator checks that an injector pilot adjustment and directional controls are set to the appropriate position to begin automated control according to operations procedures. The operator initiates a change in the data integration module 414 from paused to active. The data integration module 414 sends an active signal to the job master module 412, which then sends the active signal to the integration module 432. The integration module 432 sends a coil rate and depth signal from the integration module 432 to the valve controller 442, which implements the coil rate and follows the depth signal provided by the integration module 432. The valve controller 442 monitors a maximum pull and snub limits of the coiled tubing unit 100 that are defined by the data integration module 414. The data integration module 414 uses real-time updates to provide the target depth at which the next weight test (i.e., a verification procedure) is to be performed or obstacle is expected to be encountered along with an associated coil rate recommendation. This enables automated run-in-hole of the coiled tubing.

The pausing procedure occurs when the operator initiates a change in the data integration module 414 from active to paused. According to aspects of the present disclosure, this may occur automatically upon completion of run-in-hole and may occur during the waiting period as described herein. The data integration module 414 sends a paused signal to the job master module 412, which sends the paused signal to the integration module 432. The integration module 432 stops sending the coil rate and depth signal from the data integration module 414 to the valve controller 442 and sets the coil rate to zero, effectively stopping the coiled tubing unit 100.

The fault procedure begins when the integration module 432 detects a fault condition as described herein. The integration module 432 sends the low-level common fault signal to the job master module 412. The data integration module 414 reads the low-level common fault signal from the job master module 412. The integration module 432 stops sending the coil rate and depth signal from the data integration module 414 to the valve controller 442 and sets the coil rate to zero. The integration module 414 also sends a not ready signal to the job master module 412, and the data integration module 432 remains not ready until the fault condition has been removed/satisfied).

The weight test control procedure (or verification procedure) begins when the data integration module 414 reads a depth that matches a next weight test depth. The data integration module 414 sets the coil rate to zero, and the valve controller 442 decreases the coil rate to zero as the coiled tubing approaches the target depth. The data integration module 414 waits until the coil rate feedback from the job master module 412 is zero and then sets the depth to the current depth minus a pull distance. The valve controller 442 changes the directional value from run-in-hole to run-out-of-hole, increases the coil rate and then decreases the coil rate to zero as the coiled tubing is approaching a target pull distance. The data integration module 414 waits until the coil rate feedback from the job master module 412 is zero, waits a target time for a weight gauge measurement to stabilize, then compares the weight gauge measurement with an expected weight test measurement. If the results do not correlate to the expected weight test measurement, the data integration module 414 returns a fault and automated control is forced to a paused state. However, if the weight test is as expected, the valve controller 442 follows increases the coil rate and continues to the next depth.

The obstacle navigation control sequence begins when the data integration module 414 reads a starting depth where obstacles (e.g., formation changes, etc.) are expected. The data integration module 414 sets the coil rate to a recommended rate for the obstacle being navigated. The valve controller 442 decreases the coil rate to the recommended rate. If an ending depth of the obstacle cannot be reached, the data integration module 414 returns a fault and automated control is forced to a paused state. However, if the obstacle is navigated, the valve controller 442 increases the coil rate to the rate recommended by the data integration module 414.

Examples of local control mode procedures can include a starting procedure, a stopping procedure, a fault procedure, and a depth calculation select procedure.

At the beginning of the starting procedure, an operator checks that the injector pilot adjustment and direction controls are set to the appropriate position to begin automated control according to operations procedures. Upon initiation of the starting procedure, the local controller 452 sends a start signal to the integration module 432, which sends the coil rate and depth signal from the local controller 452 to the valve controller 442. The valve controller 442 increases the coil rate and follows the depth signal provided by the integration module 432. The integration module 432 sends a running signal to the local controller 452 and monitors the maximum pull and snub limits provided by the data integration module 414. The operator can optionally override the limits via the local controller 452.

The stopping sequence begins when the operator selects a sop option via the local controller 452. The local controller 452 sends a stop signal to the integration module 432, which stops sending the coil rate and depth signal from the local controller 452 to the valve controller 442 and sets the coil rate to zero. The valve controller 442 decreases the coil rate to zero, and the integration module 432 sends a not running signal to the local controller 452.

The fault procedure is initiated when the integration module 432 detects a fault. The integration module 432 sends a fault signal to the local controller 452 and stops sending the coil rate and the depth signal from the local controller 452 to the valve controller 442 and sets the coil rate to zero. The valve controller 442 decreases the coil rate to zero. The integration module 432 sends a not running signal to the local controller 452, and the local controller 452 can be restarted after a reset is initiated and/or the fault condition is corrected.

The depth calculation select procedure begins when an operator initiates a depth calculation through the local controller 452. The local controller 452 sends a depth calculation select signal to the integration module 432. Using the depth calculation select signal, the integration module 432 chooses the calculated depth from the coiled tubing data acquisition module 422 as the depth is sent to the data integration module 414 for the calculation of automation set points (e.g., coil rates, target depths, etc.).

It should be appreciated that each of these procedures can be partially and/or wholly implemented as the automated coiled tubing control plan. It should further be appreciated that the automated coiled tubing control plan can include any suitable number and combination of these procedures.

Embodiment 1

A computer-implemented method for controlling a coiled tubing unit at a well site, the method comprising: receiving, by a processing device, wellbore data; generating, by the processing device, an automated coiled tubing control plan for the coiled tubing unit based at least in part on the wellbore data; and controlling, by the processing device, the coiled tubing unit using the automated coiled tubing control plan to cause coiled tubing to run into a wellbore at the well site to a target depth, wait a waiting period of time, and cause the coiled tubing to run out of the wellbore.

Embodiment 2

The method according to at least one of the previous embodiments, wherein controlling the coiled tubing unit comprises controlling a hydraulic system that controls an injector head of the coiled tubing unit.

Embodiment 3

The method according to at least one of the previous embodiments, wherein the automated coiled tubing control plan sets a coil rate, a direction, and a force for controlling the coiled tubing unit.

Embodiment 4

The method according to at least one of the previous embodiments, wherein the coil rate, the direction, and the force are set differently for different depths.

Embodiment 5

The method according to at least one of the previous embodiments, wherein causing the coiled tubing to run out of the wellbore at the well site comprises one of causing the coiled tubing to run fully out of the wellbore or causing the coiled tubing to run partially out of the wellbore.

Embodiment 6

The method according to at least one of the previous embodiments, wherein an end of the coiled tubing in the wellbore comprises a sensor, and wherein the automated coiled tubing control plan is updated based at least in part on data received from the sensor.

Embodiment 7

The method according to at least one of the previous embodiments, wherein controlling the coiled tubing unit using the automated coiled tubing control plan performs a verification procedure while causing the coiled tubing to run into the wellbore.

Embodiment 8

The method according to at least one of the previous embodiments further comprising enabling an operator to control the coiled tubing unit during the waiting period of time.

Embodiment 9

The method according to at least one of the previous embodiments, wherein the automated coiled tubing control plan defines at least one of a ready procedure, an automated control mode procedure, and a local control mode procedure.

Embodiment 10

A system for controlling a coiled tubing unit at a well site, the system comprising: a memory comprising computer readable instructions; and a processing device for executing the computer readable instructions for performing a method, the method comprising: receiving, by the processing device, data; generating, by the processing device, an automated coiled tubing control plan for the coiled tubing unit based at least in part on the data, wherein the automated coiled tubing control plan comprises a plurality of set points; and controlling, by the processing device, the coiled tubing unit using the automated coiled tubing control plan by applying the plurality of set points during an operation.

Embodiment 11

The system according to at least one of the previous embodiments, wherein at least one of the plurality of set points defines a coil rate for controlling the coiled tubing unit.

Embodiment 12

The system according to at least one of the previous embodiments, wherein at least one of the plurality of set points defines a target depth for controlling the coiled tubing unit.

Embodiment 13

The system according to at least one of the previous embodiments, wherein at least one of the plurality of set points defines a force for controlling the coiled tubing unit.

Embodiment 14

The system according to at least one of the previous embodiments, wherein controlling the coiled tubing unit comprises controlling a hydraulic system that controls an injector head of the coiled tubing unit.

Embodiment 15

The system according to at least one of the previous embodiments, wherein an end of the coiled tubing in a wellbore comprises a sensor, and wherein the automated coiled tubing control plan is updated based at least in part on data received from the sensor.

Embodiment 16

The system according to at least one of the previous embodiments, further comprising extracting hydrocarbons from the wellbore using the coiled tubing unit.

Embodiment 17

The system according to at least one of the previous embodiments, wherein the operation is selected from the group consisting of a run-in-hole operation and a run-out-of-hole operation.

The use of the terms "a" and "an" and "the" and similar referents in the context of describing the present disclosure (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure can be used in a variety of well operations. These operations can involve using one or more treatment agents to treat a formation, the fluids resident in a formation, a wellbore, and/or equipment in the wellbore, such as production tubing. The treatment agents can be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the present disclosure has been described with reference to an exemplary embodiment or embodiments, it will be understood by those skilled in the art that various changes can be made and equivalents can be substituted for elements thereof without departing from the scope of the present disclosure. In addition, many modifications can be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims. Also, in the drawings and the description, there have been disclosed exemplary embodiments of the present disclosure and, although specific terms can have been employed, they are unless otherwise stated used in a generic and descriptive sense only and not for purposes of limitation, the scope of the present disclosure therefore not being so limited.

What is claimed is:

1. A computer-implemented method for controlling a coiled tubing unit at a well site, the method comprising:

creating, by a processing device, a coiled tubing simulation for performing a coiled tubing operation;

receiving, by the processing device, wellbore data, wherein the wellbore data comprises surface data collected using at least a surface sensor at a surface of the well site and downhole data collected using at least a downhole sensor downhole in a wellbore;

generating, by the processing device, an automated coiled tubing control plan for the coiled tubing unit based at least in part on the wellbore data and the coiled tubing simulation;

controlling, by the processing device, the coiled tubing unit using the automated coiled tubing control plan to cause coiled tubing to run into the wellbore at the well site to a target depth, wait a waiting period of time, and cause the coiled tubing to run out of the wellbore; and adjusting, by the processing device, the automated coiled tubing control plan based at least in part on a sensed condition during the controlling of the coiled tubing unit, wherein controlling the coiled tubing unit using the automated coiled tubing control plan performs a verification procedure while causing the coiled tubing to run into the wellbore, wherein the verification procedure comprises:

causing the coiled tubing to stop running into the wellbore;

causing the coiled tubing to reverse a predetermined distance;

causing testing a weight on the coiled tubing; and determining whether the weight on the coiled tubing matches an expected weight.

2. The computer-implemented method of claim 1, wherein controlling the coiled tubing unit comprises controlling a hydraulic system that controls an injector head of the coiled tubing unit.

3. The computer-implemented method of claim 1, wherein the automated coiled tubing control plan sets a coil rate, a direction, and a force for controlling the coiled tubing unit.

4. The computer-implemented method of claim 3, wherein the coil rate, the direction, and the force are set differently for different depths.

5. The computer-implemented method of claim 1, wherein causing the coiled tubing to run out of the wellbore at the well site comprises one of causing the coiled tubing to run fully out of the wellbore or causing the coiled tubing to run partially out of the wellbore.

6. The computer-implemented method of claim 1, wherein an end of the coiled tubing in the wellbore comprises a sensor, and wherein the automated coiled tubing control plan is adjusted based at least in part on data received from the sensor.

7. The computer-implemented method of claim 1, further comprising enabling an operator to control the coiled tubing unit during the waiting period of time.

8. The computer-implemented method of claim 1, wherein the automated coiled tubing control plan defines at least one of a ready procedure, an automated control mode procedure, and a local control mode procedure.

9. The computer-implemented method of claim 1, wherein the verification procedure further comprises:

responsive to determining that the weight on the coiled tubing matches the expected weight, continuing to cause the coiled tubing to run into the wellbore.

10. The computer-implemented method of claim 1, wherein the verification procedure further comprises:

responsive to determining that the weight on the coiled tubing does not match the expected weight, causing at least one of aborting causing the coiled tubing to run into the wellbore, taking a corrective action by an operator, or automatically implementing the corrective action.

11. A system for controlling a coiled tubing unit, the system comprising:

a memory comprising computer readable instructions; and a processing device for executing the computer readable instructions for performing a method for controlling the coiled tubing unit at a well site comprising a wellbore, the method comprising:

creating, by the processing device, a coiled tubing simulation for performing a coiled tubing operation;

receiving, by the processing device, wellbore data, wherein the wellbore data comprises surface data collected using at least a surface sensor at surface of the well site and downhole data collected using at least a downhole sensor downhole in the wellbore;

generating, by the processing device, an automated coiled tubing control plan for the coiled tubing unit based at least in part on the wellbore data and the coiled tubing simulation, wherein the automated coiled tubing control plan comprises a plurality of set points;

controlling, by the processing device, the coiled tubing unit using the automated coiled tubing control plan by applying the plurality of set points during the coiled tubing operation, wherein controlling the coiled tubing unit using the automated coiled tubing control plan comprises causing coiled tubing of the coiled tubing unit to run into the wellbore at the well site to a target depth, waiting a waiting period of time, and causing the coiled tubing to run out of the wellbore; and adjusting, by the processing device, the automated coiled tubing control plan based at least in part on a sensed condition during the controlling of the coiled tubing unit, wherein controlling the coiled tubing unit using the automated coiled tubing control plan performs a verification procedure while causing the coiled tubing to run into the wellbore, wherein the verification procedure comprises:

causing the coiled tubing to stop running into the wellbore;

causing the coiled tubing to reverse a predetermined distance;

causing testing a weight on the coiled tubing; and determining whether the weight on the coiled tubing matches an expected weight.

12. The system of claim 11, wherein at least one of the plurality of set points defines a coil rate for controlling the coiled tubing unit.

13. The system of claim 11, wherein at least one of the plurality of set points defines the target depth for controlling the coiled tubing unit.

14. The system of claim 11, wherein at least one of the plurality of set points defines a force for controlling the coiled tubing unit.

15. The system of claim 11, wherein controlling the coiled tubing unit comprises controlling a hydraulic system that controls an injector head of the coiled tubing unit.

16. The system of claim 11, wherein an end of the coiled tubing in the wellbore comprises a sensor, and wherein the automated coiled tubing control plan is adjusted based at least in part on data received from the sensor.

17. The system of claim 11, further comprising extracting hydrocarbons from the wellbore using the coiled tubing unit.

* * * * *